US010412497B2

(12) United States Patent
Sancisi et al.

(10) Patent No.: US 10,412,497 B2
(45) Date of Patent: Sep. 10, 2019

(54) LOUDSPEAKER WITH VIBRATION CONTROL SYSTEM

(71) Applicant: ASK INDUSTRIES SOCIETA' PER AZIONI, Monte San Vito (AN) (IT)

(72) Inventors: Carlo Sancisi, Chiaravalle (IT); Dario Cinanni, Senigallia (IT); Andrea Falcioni, Senigallia (IT)

(73) Assignee: ASK INDUSTRIES SOCIETA' PER AZIONI, Monte San Vito (AN) (IT)

( * ) Notice: Subject to any disclaimer, the term of this patent is extended or adjusted under 35 U.S.C. 154(b) by 0 days.

(21) Appl. No.: 15/933,025

(22) Filed: Mar. 22, 2018

(65) Prior Publication Data

US 2018/0288529 A1 Oct. 4, 2018

(30) Foreign Application Priority Data

Mar. 29, 2017 (IT) ..... 102017000034713

(51) Int. Cl.

| | |
|---|---|
| ***H04R 9/04*** | (2006.01) |
| ***H04R 9/02*** | (2006.01) |
| ***H04R 9/06*** | (2006.01) |
| ***H04R 7/18*** | (2006.01) |

(52) U.S. Cl.

CPC ..... *H04R 9/046* (2013.01); *H04R 7/18* (2013.01); *H04R 9/025* (2013.01); *H04R 9/041* (2013.01); *H04R 9/06* (2013.01); *H04R 2209/027* (2013.01)

(58) Field of Classification Search

CPC ..... H04R 9/025; H04R 9/041; H04R 9/046; H04R 9/06; H04R 7/18; H04R 2209/027

See application file for complete search history.

(56) References Cited

U.S. PATENT DOCUMENTS

| | | | | | |
|---|---|---|---|---|---|
| 2,539,672 | A * | 1/1951 | Olson | H04R 1/24 | 181/144 |
| 4,495,638 | A * | 1/1985 | Yamada | A61H 23/0236 | 381/27 |
| 4,550,428 | A * | 10/1985 | Yanagishima | H04R 9/04 | 381/407 |
| 4,720,868 | A * | 1/1988 | Hirano | H04R 1/24 | 381/182 |
| 5,583,944 | A * | 12/1996 | Morohoshi | H04R 1/06 | 381/400 |
| 5,894,263 | A * | 4/1999 | Shimakawa | G08B 6/00 | 340/384.1 |

(Continued)

FOREIGN PATENT DOCUMENTS

| | | |
|---|---|---|
| CN | 204031441 U | 12/2014 |
| WO | 2014/072299 A1 | 5/2014 |

*Primary Examiner* — Joshua Kaufman

(74) *Attorney, Agent, or Firm* — Egbert, McDaniel & Swartz, PLLC

(57) ABSTRACT

A loudspeaker with vibration control system includes: a magnetic assembly with an air gap, a voice coil supported by a cylindrical support, a basket connected to the magnetic assembly, a centering device connected to the basket and to the cylindrical support, a membrane connected to the basket and to the cylindrical support, an external cylinder disposed around the magnetic assembly, at least one control coil supported by the external cylinder and directed towards the magnetic assembly, at least one elastic suspension connected to the external cylinder to permit an axial movement of the external cylinder with respect to the magnetic assembly.

9 Claims, 9 Drawing Sheets

(56) References Cited

U.S. PATENT DOCUMENTS

| | | | | |
|---|---|---|---|---|
| 6,269,168 | B1 * | 7/2001 | Tagami | H04R 9/025 381/412 |
| 6,373,958 | B1 * | 4/2002 | Enomoto | B06B 1/0246 381/406 |
| 6,611,605 | B2 * | 8/2003 | Kim | H04R 9/025 381/396 |
| 6,754,363 | B2 * | 6/2004 | Chang | B06B 1/045 381/401 |
| 6,766,034 | B2 * | 7/2004 | Kobayashi | G10K 9/13 381/396 |
| 6,810,128 | B2 * | 10/2004 | Kaneda | B06B 1/045 340/388.1 |
| 7,010,140 | B2 * | 3/2006 | Furuya | H04M 1/03 381/396 |
| 7,076,079 | B2 * | 7/2006 | Chung | B06B 1/045 381/396 |
| 8,396,244 | B2 * | 3/2013 | Huang | H04R 9/06 381/386 |
| 2001/0017922 | A1 * | 8/2001 | Kim | H04R 9/025 381/150 |
| 2009/0190794 | A1 * | 7/2009 | French | H04R 3/00 381/400 |
| 2012/0020479 | A1 * | 1/2012 | Zhang | H04R 9/025 381/17 |
| 2013/0301866 | A1 * | 11/2013 | Bank | H04R 31/003 381/401 |
| 2015/0280634 | A1 * | 10/2015 | Servadio | H04R 9/045 318/126 |

* cited by examiner

LOUDSPEAKER WITH VIBRATION CONTROL SYSTEM

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present patent application for industrial invention relates to a solution for controlling the vibrations generated by a loudspeaker and induced on a baffle (box, panel, door panel, rear shelf, etc.) where the loudspeaker is mounted.

2. Description of Related Art Including Information Disclosed Under 37 CFR 1.97 and 37 CFR 1.98

With reference to FIGS. 1 and 2, a loudspeaker (100) of traditional type comprises a magnetic assembly (M) wherein an air gap (T) is generated. The magnetic assembly (M) comprises a magnet (28) disposed between a lower polar plate (2) and an upper polar plate (29).

The lower polar plate (2) has a "T"-shaped section and is commonly known as a "T-yoke". The lower polar plate (2) comprises a cylindrical shank, known as core (20). The magnet (28) and the upper polar plate (29) have a toroidal shape. The air gap (T) is formed between the core (20) of the lower polar plate and the upper polar plate (29).

A voice coil (3) is mounted on a cylindrical support (30) and is disposed in the air gap (T) of the magnetic assembly, with possibility of moving in axial direction. A basket (4) is fixed to the magnetic assembly (M).

A centering device (5) is fixed to the basket (4) and to the cylindrical support (30) of the voice coil in such way as to maintain the voice coil (3) in the air gap (T) of the magnetic assembly. A membrane (6) is fixed to the basket (4) and to the cylindrical support (30) of the voice coil.

The loudspeaker (100) is suitable for being connected to a baffle (not shown) by means of the external edge of the basket (4).

When the voice coil (3), which is immersed in a radial magnetic field, is crossed by electrical current, according to the Lorentz law, a force is generated, which causes the axial movement of the cylindrical support (30) of the voice coil, causing the movement and the vibration of the membrane (6) that generates a sound. Therefore the loudspeaker (100) produces sounds because of the displacement of the membrane (6).

The loudspeaker comprises a moving part comprising: the membrane (6), the centering device (5), and the cylindrical support (30) with the voice coil (3). Because of the movement of its inertial mass, the moving part can generate vibrations induced on the baffle where the loudspeaker is mounted. As a result, the baffle can vibrate and generate spurious sounds.

With reference to FIG. 1A, it must be noted that, in a traditional loudspeaker, peripheral magnetic induction lines (I), which are dispersed outside and are not used, are generated in the vicinity of the peripheral edge of the magnetic assembly (M).

Moreover, in some applications, it is necessary to increase the vibrations of the baffle in correspondence of the low frequency sounds emitted by the loudspeaker. In such a case, a system capable of effectively controlling the vibrations of the baffle is desirable.

U.S. Pat. No. 4,720,868 discloses a dynamic speaking device having a small-sized vibrating plate for reproducing a high frequency sound and an additional coil in the vicinity of the magnet assembly of the speaker.

BRIEF SUMMARY OF THE INVENTION

The purpose of the present invention is to eliminate the drawbacks of the prior art by disclosing a loudspeaker with vibration control system that is capable of controlling the vibrations of the baffle whereon the loudspeaker is mounted.

Another purpose is to obtain such a loudspeaker that is compact, inexpensive and simple to make and install.

These purposes are achieved according to the invention with the characteristics of the independent claim 1.

Advantageous embodiments of the invention appear from the dependent claims.

In order to oppose the vibrations of the baffle whereon the loudspeaker is mounted, the invention provides for integrating a shaker in the loudspeaker structure. The shaker, which is suitably powered with an electrical signal, generates induced vibrations on the baffle, which are suitable for opposing and reducing/suppressing the undesired vibrations that are induced by the movement of the moving part of the loudspeaker.

BRIEF DESCRIPTION OF THE SEVERAL VIEWS OF THE DRAWINGS

Additional features of the invention will appear dearer from the detailed description below, which refers to merely illustrative, not limiting embodiments, wherein.

In the following description the parts that are identical or correspond to the parts described above are identified with the same numerals, omitting their detailed description.

DETAILED DESCRIPTION OF THE INVENTION

Figure 1:
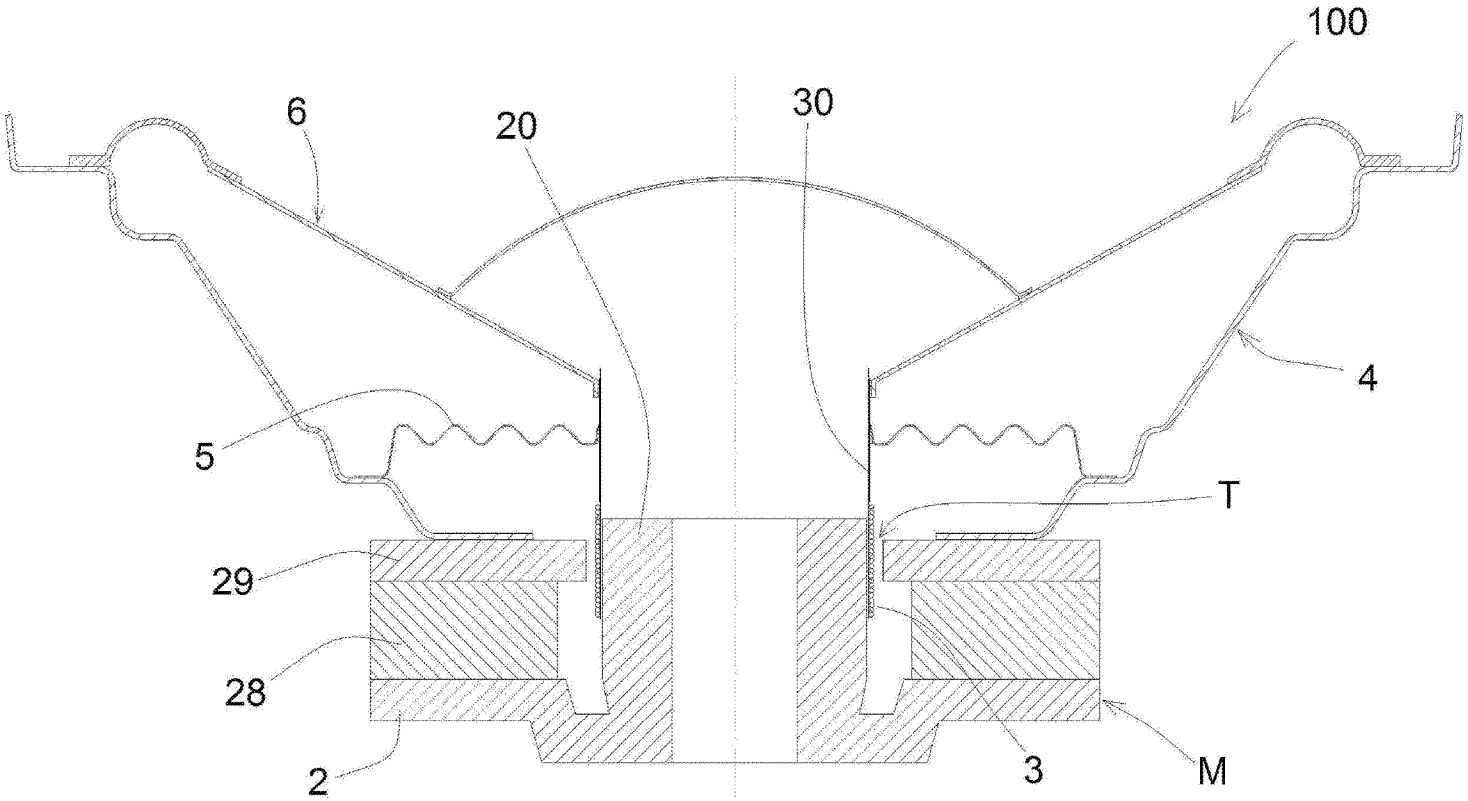
FIG. 1 PRIOR ART
FIG. 1 is an axial sectional view of a traditional loudspeaker.
Figure 1A:
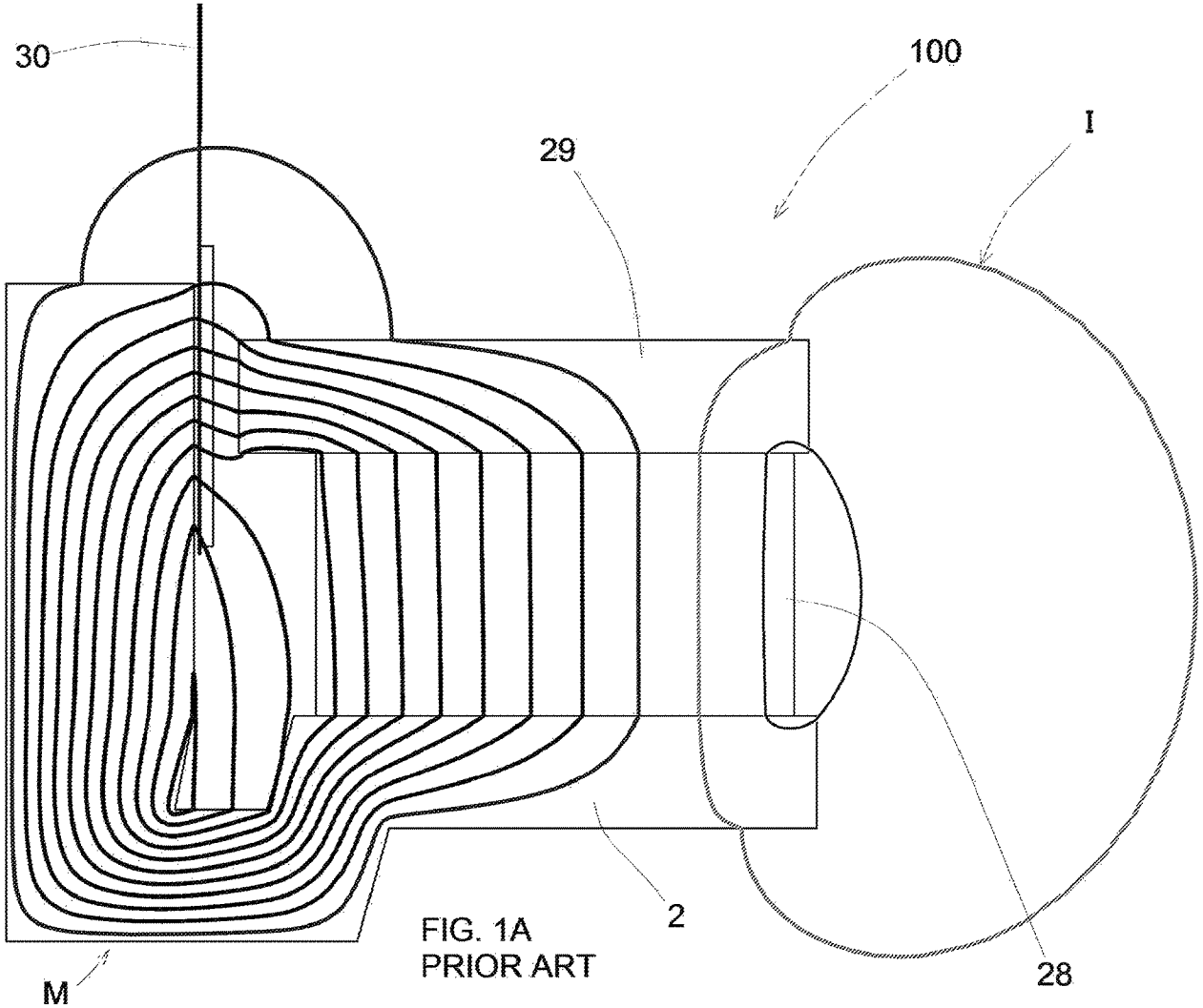
FIG. 1A PRIOR ART
FIG. 1A is a detailed view of FIG. 1 that shows the magnetic induction lines in a traditional loudspeaker.
Figure 2:
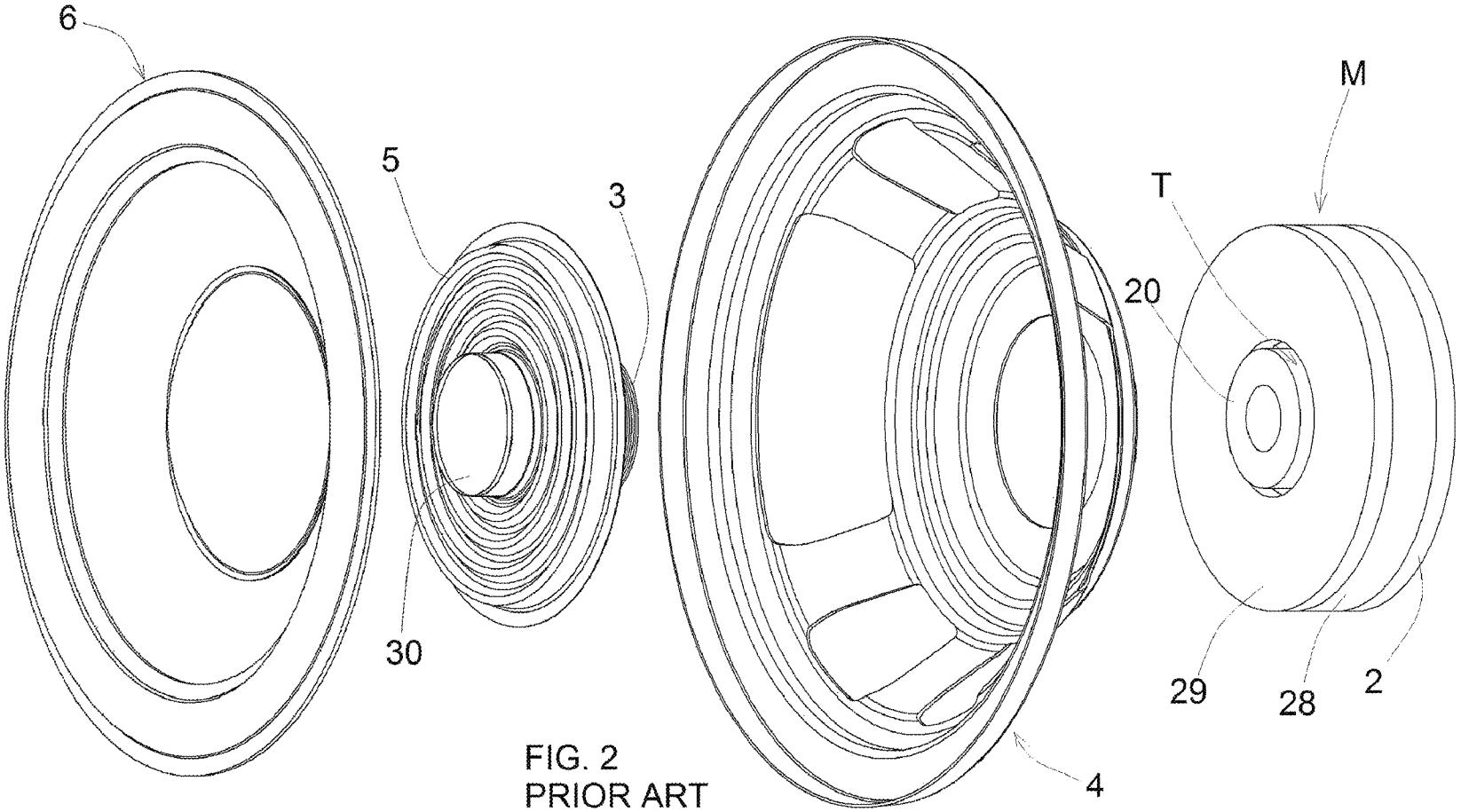
FIG. 2 PRIOR ART
FIG. 2 is an exploded perspective view of the various elements of the loudspeaker of FIG. 1.
Figure 3:
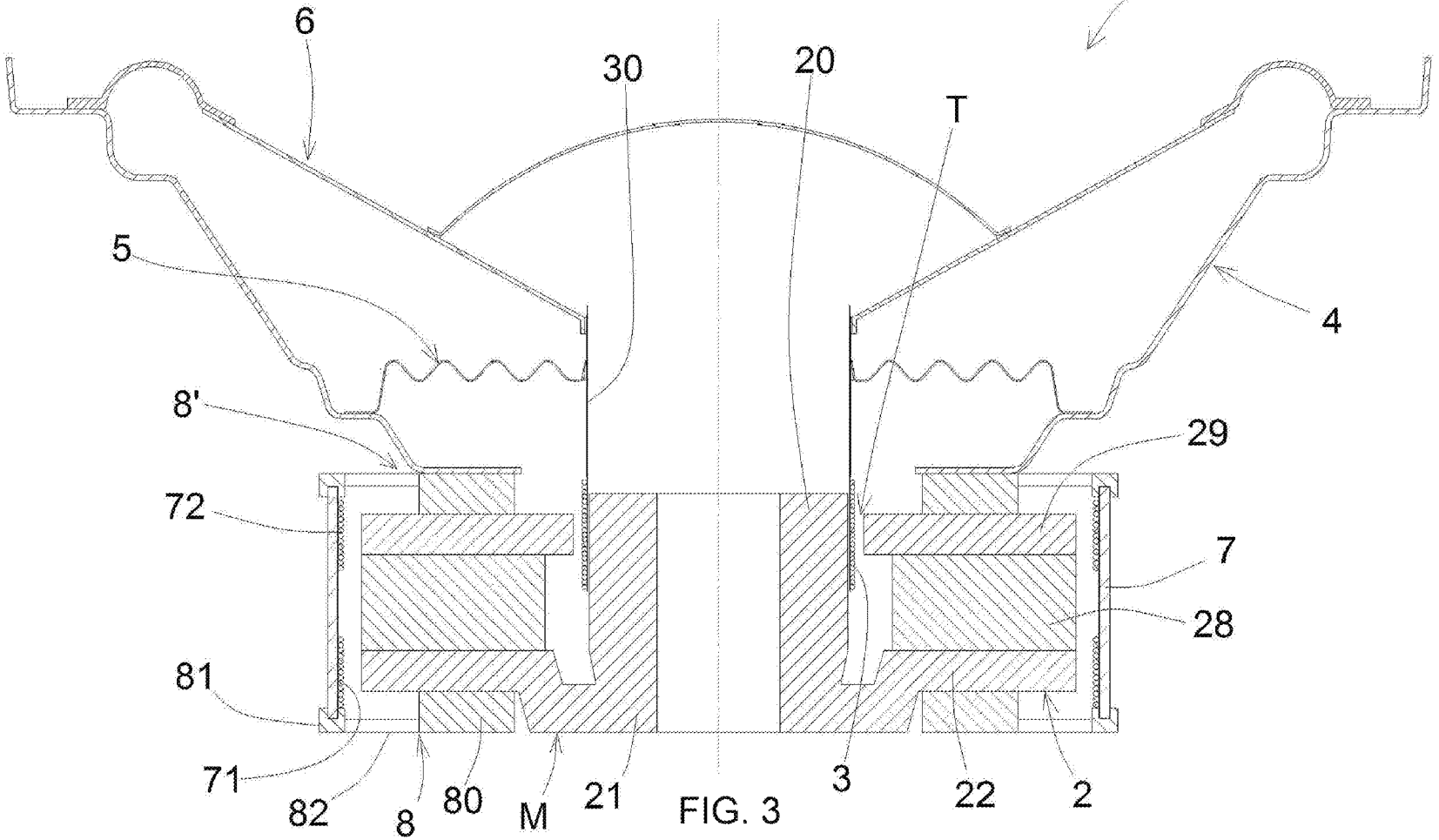
FIG. 3 is an axial sectional view of a loudspeaker according to the invention.
Figure 4:
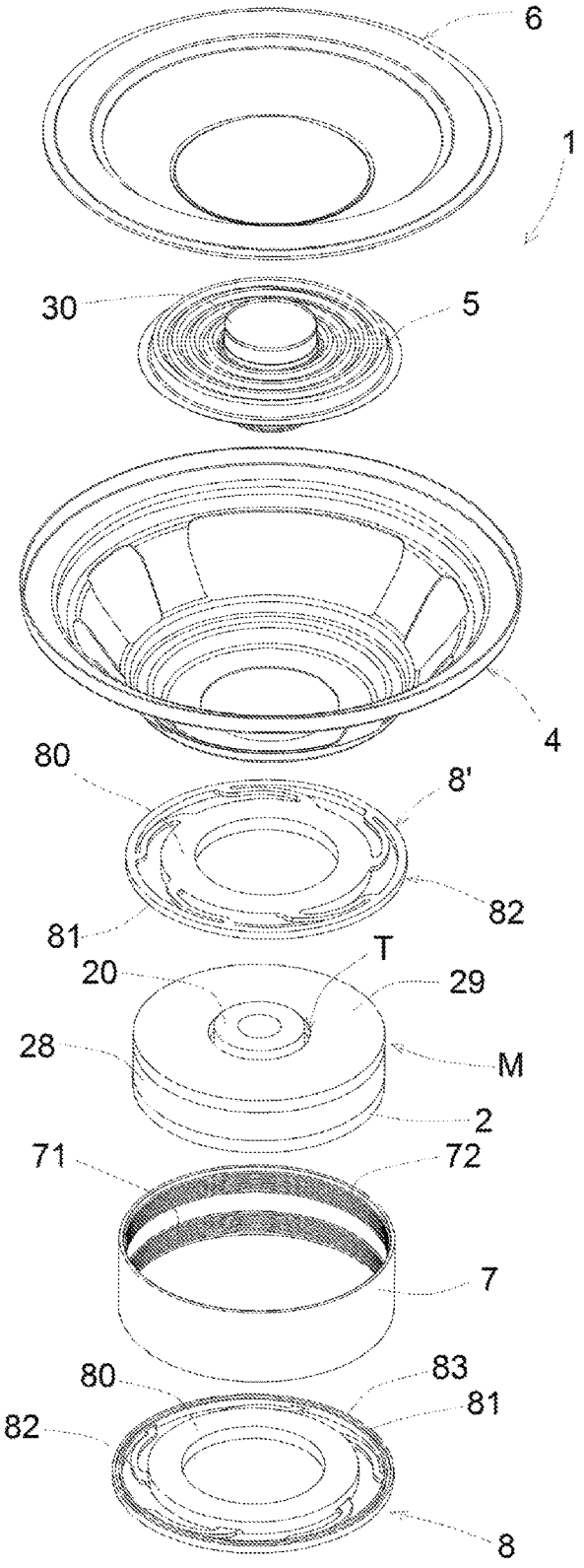
FIG. 4 is an exploded perspective view of the various parts of the loudspeaker of FIG. 3.

With reference to FIGS. 3 and 4, a loudspeaker according to the invention is disclosed, which is generally indicated with reference numeral 1.

The loudspeaker (1) comprises an external cylinder (7) disposed around said magnetic assembly (M). The external cylinder is made of ferromagnetic material. The external cylinder (7) supports at least one control coil (71, 72) directed towards the magnetic assembly (M).

At least one elastic suspension (8, 8') is connected to the external cylinder (7) and to the magnetic assembly (M) in such way as to maintain the external cylinder (7) in coaxial position relative to the magnetic assembly. In view of the above, when powering the control coil (71, 72), the external cylinder (7) can move axially, using the magnetic field of the magnetic assembly (M). The movement of the external cylinder (7) relative to the magnetic assembly (M) permits to control the vibration on the baffle (not shown in the drawings) where the loudspeaker is mounted.

The magnetic assembly (M), the external cylinder (7) that supports at least one control coil (71, 72), and the elastic suspension (8, 8') operate as a shaker having the external cylinder (7) that supports at least one control coil (71, 72) as inertial mass.

In the example of FIGS. 3 and 4, the loudspeaker (1) comprises a first control coil (71) and a second control coil (72) mounted on the external cylinder (7). The first control coil (71) and the second control coil (72) are respectively disposed in the lower polar plate (2) and in the upper polar plate (29) of the magnetic assembly.

The loudspeaker (1) comprises:

- a first elastic suspension (8) fixed to the lower polar plate (2) and to a lower edge of the external cylinder (7) and
- a second elastic suspension (8') fixed to the upper polar plate (29) and to an upper edge of the external cylinder (7).

Each elastic suspension (8, 8') comprises an internal ring (80) suitable for being fixed to the magnetic assembly (M), and an external ring (81) suitable for being fixed to the external cylinder (7). A plurality of spokes (81) connects the internal ring (80) to the external ring (81) of the elastic suspension. The spokes (82) have a very low thickness in order to bend elastically. The spokes (82) have a substantially "S"-shaped curvilinear shape. The external ring (81) has a groove (83) suitable for receiving one edge of the external cylinder (7). The internal ring (80) has a planar surface that is suitable for being glued on the magnetic assembly (7).

The lower polar plate (2) comprises:

- a central portion (21) from where the core (20) protrudes, and
- a peripheral portion (22) that is recessed with respect to the central portion (21).

Obviously, the lower polar plate (2) can have a lower planar surface.

The internal ring (80) of the elastic suspension is fixed to the peripheral portion (22) of the lower polar plate and is provided with a suitable thickness so that the lower surface of the elastic suspension is substantially at the same level as the lower surface of the central portion (21) of the lower polar plate.

Figure 3A:
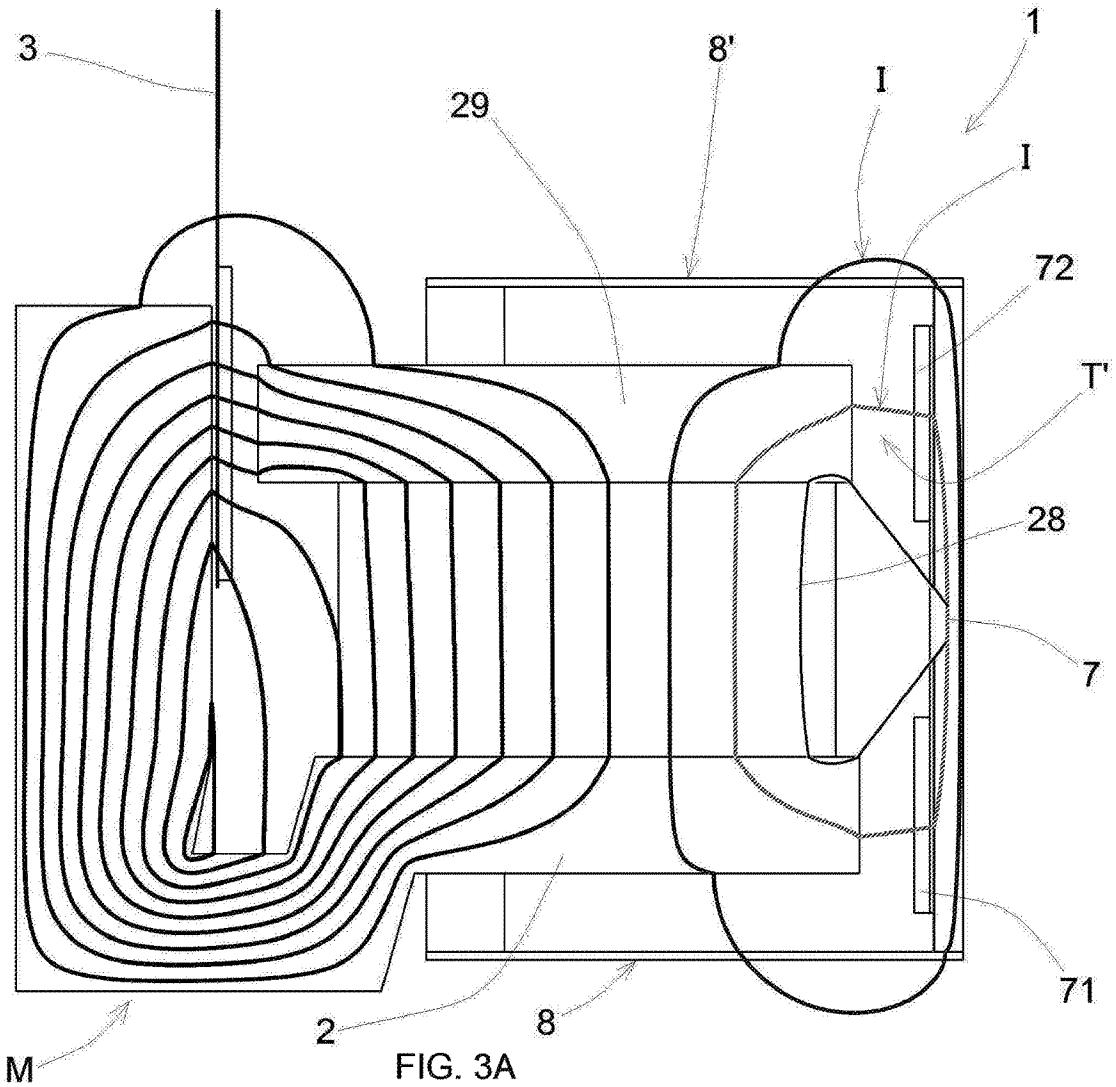
FIG. 3A is a detailed view of FIG. 3 that shows the magnetic induction lines in the loudspeaker according to the invention.

With reference to FIG. 3A, an air gap (T') with peripheral magnetic induction lines (I) is generated between the peripheral edges of the magnetic assembly (M) and the external cylinder (7) of the loudspeaker (1). Radial peripheral lines (I') that affect the air gap (T') are found between said peripheral lines. In such a case, unlike in traditional loudspeakers, the peripheral magnetic induction lines (I) are not dispersed outside, but are conveyed by the ferromagnetic external cylinder (7) and radially pass through the air gap (T') where the control coils (71, 72) fixed to the external cylinder (7) are positioned. When the electrical current powers the control coils (71, 72), the Lorentz force causes a displacement of the control coils (71, 72) and of the external cylinder (7) whereon they are glued.

The two control coils (71, 72) are generally connected in series. In the control coils (71, 72) the current generally circulates in opposite direction.

Figure 5:
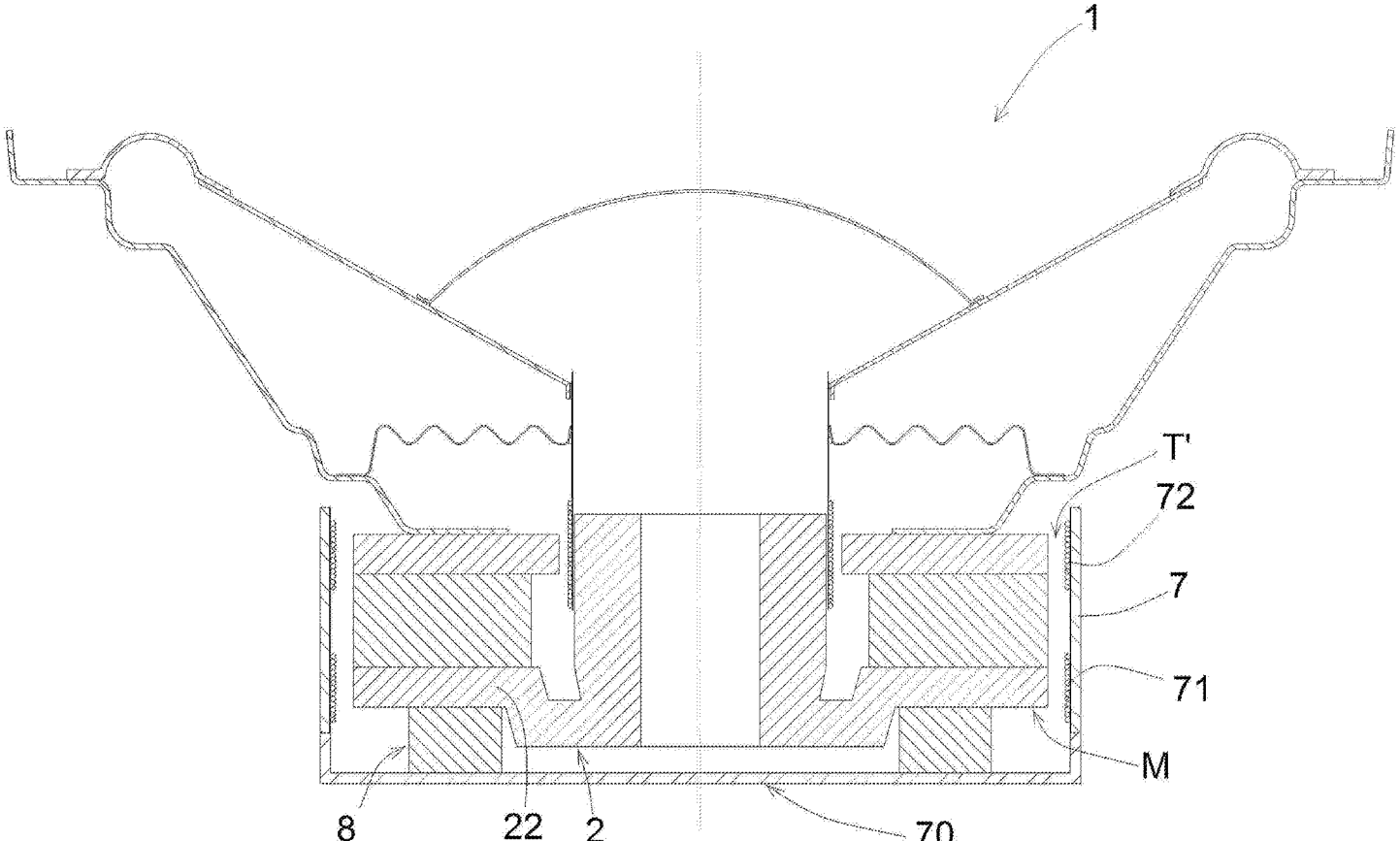
FIGS. 5 and 6 are sectional views that show additional embodiments of the loudspeaker according to the invention.

FIG. 5 shows a second embodiment of the loudspeaker (100), wherein the external cylinder (7) is integrated in a cup (70) that extends under the magnetic assembly (M). The cup (70) is connected to the lower polar plate (22) of the magnetic assembly through at least one elastic suspension (8).

The elastic suspension (8) can comprise leaf springs, helical springs, wave springs or elastic elements of plastic material (rubber, silicone rubber, polyurethane foam, etc.). As shown in FIG. 3, two elastic suspensions (8) may be provided, which comprise an internal ring fixed to the lower polar plate (2), an external ring fixed to the external cylinder (7) and spokes that connect the internal ring and the external ring.

The external cylinder (7) can be made in one piece with the cup (70); in such a case, the entire part will be made of ferromagnetic material.

Alternately, the cup (70) can be partially made of plastic material, in the bottom of the cup. In such a case, the plastic portion of the cup (70) can integrate the elastic suspensions, at least partially. The cup (70) can comprise the external cylinder (7) of ferromagnetic material and the bottom of plastic material obtained, for example, by co-molding two different materials (a ferromagnetic material and a plastic material). The plastic portion of the cup (70) can integrate two elastic suspensions.

In the solutions shown in FIGS. 3 and 5, two air gaps are obtained in correspondence of the two control coils (71, 72). Nevertheless, the loudspeaker (1) can be provided with only one control coil that is immersed in an air gap.

Figure 6:
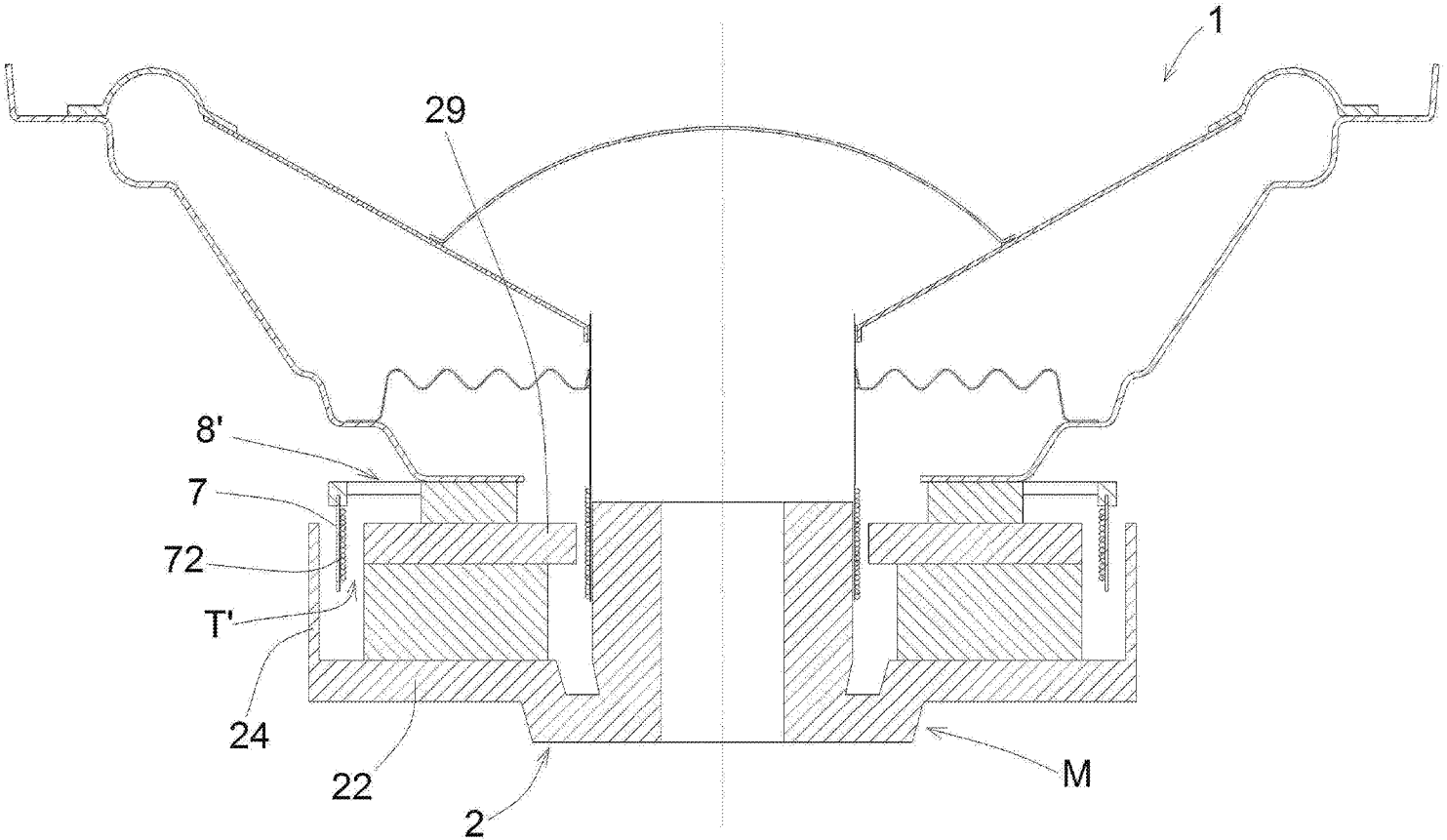

FIG. 6 shows a third embodiment of the loudspeaker (1), which is provided with only one control coil (72) disposed in correspondence of the peripheral edge of the upper polar plate (29). In such a case, the inertial mass of the shaker is represented by the mass of the control coil (72) and of the external cylinder (7), eventually integrated with additional masses (not shown in the drawings) fixed to the external cylinder (7). In this case, the external cylinder should not be made of ferromagnetic material because it would interfere with the magnetic induction lines in the air gap.

The external cylinder (7) that supports the control coil (72) is fixed to the upper polar plate (29) by means of an elastic suspension (8').

The external diameter of the lower polar plate (22) is higher than the diameter of the magnet (28) and of the upper polar plate (29). The lower polar plate (22) has a peripheral collar (24) that protrudes in upper position from the edge of the lower polar plate and is disposed outside the external cylinder (7). In view of the above, an air gap (T') is formed between the upper polar plate (29) and the peripheral collar (24) of the lower polar plate. Therefore the control coil (72) is disposed in said air gap (T').

The loudspeaker (100) of the invention provides for integrating a traditional loudspeaker (with a vibrating membrane) with an inertial system (shaker) that provides for one external cylinder (7) with at least one control coil (71, 72) disposed in the magnetic field generated outside the magnetic assembly (M) of the traditional loudspeaker. The control coil (71, 72) of the inertial system is electrically powered with suitable signals in order to:

- reduce the vibrations induced on the baffle, in noise reduction applications, or
- enhance the vibrations induced on the baffle, in bass enhancement applications (bass booster).

The bass booster applications are required when a vibratory sensation is desired, together with an acoustic sensation. For instance, said bass enhancement applications can be obtained by integrating the loudspeaker (1) according to the invention in a seat. In this way, the user will perceive an increase of the seat vibrations produced by the movement of the shaker, simultaneously with the acoustic emission of the low frequencies produced by the movement of the membrane (6) of the loudspeaker.

The control coil of the loudspeaker (1) can be electrically powered by means of DSPs, amplifiers and filters.

The loudspeaker (1) of the invention is compact and can be used in noise/vibration control applications, in ANC (active noise control) systems or in applications used to reinforce the vibrations generated by the low frequencies in audio reproduction systems.

Figure 7:
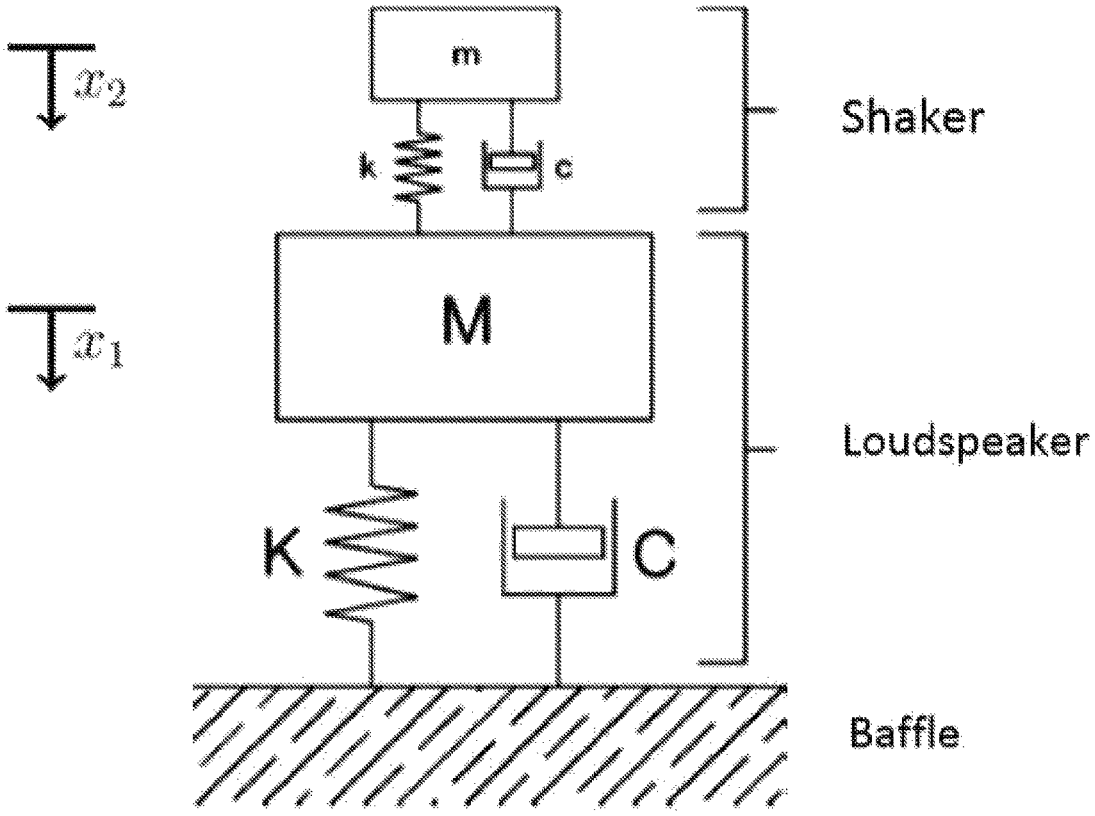
FIG. 7 is a diagrammatic view of the loudspeaker according to the invention for a mechanical study.

With reference to FIG. 7, a mechanical study of the loudspeaker (1) according to the invention is described.

In mechanics the shaker fixed to the loudspeaker can be identified and studied as a damper for dynamic vibrations, which is frequently known as a 2-DOF (two degrees of freedom) TMD (Tuned Mass Damper). A TMD is a system suitable for damping the width of an oscillator (loudspeaker) by coupling a second oscillator (shaker).

M, K, C represent the mass, stiffness and damping of the loudspeaker, respectively, whereas m, k, c represent the mass, stiffness and damping of the shaker, respectively.

With reference to FIG. 4, the mass of the loudspeaker is the weight of the cylindrical support (30), of the voice coil (3), of the centering device (5) and of the membrane (6). Instead, the mass of the shaker is the weight of the external cylinder (7) and of the control coils (71, 72).

x1 and x2 represent the absolute positions of M and m, respectively; x2 can be substituted with the relative position of m relative to M, assuming x2−x1.

Assuming that the damping force is proportional to the speed and a force p0 cos (ωt) is applied on M, simplifying with C=0, the motion of the system can be expressed in differential equations:

$$Mx1''+Kx1+k(x1-x2)+c(x1'-x2')=p0\cos(\omega t)$$

$$mx2''+k(x2-x1)+c(x2'-x1')=0$$

where x1' is the derivative in time of x1, substituting the first equation with the sum of the two:

$$Mx1''+Kx1+mx2''=p0\cos(\omega t)$$

$$mx2''+k(x2-x1)+c(x2'-x1')=0$$

Then the periodical solutions are obtained in the form:

$$x1=a\cos(\omega t)+bsen(\omega t)$$

$$x2=c\cos(\omega t)+dsen(\omega t)$$

Substituting in the differential equations, the equation system is obtained:

$$\begin{pmatrix} K-M\omega^2 & 0 & -m\omega^2 & 0 \\ 0 & K-M\omega^2 & 0 & -m\omega^2 \\ -k & -c\omega & k-m\omega^2 & c\omega \\ c\omega & -k & -c\omega & k-m\omega^2 \end{pmatrix}\begin{pmatrix} a \\ b \\ c \\ d \end{pmatrix}=\begin{pmatrix} p0 \\ 0 \\ 0 \\ 0 \end{pmatrix}$$

Calling the matrix coefficients M, M can be written in blocks and inverted:

$$W=\begin{pmatrix} 0 & 1 \\ -1 & 0 \end{pmatrix},$$

therefor $$M=\begin{pmatrix} A & B \\ C & D \end{pmatrix},$$

where:

$$A=r1I, B=r2I, C=r3I-s1W, D=r4I+s1W,$$

$$r1=K-M\Omega^2, r2=-m\omega^2, r3=-k, r4=k-m\omega^2, s1=c\omega$$

Commuting A and B, we obtain:

$$M^{-1}=\begin{pmatrix} (AD-BC)^{-1} & 0 \\ 0 & (AD-BC)^{-1} \end{pmatrix}\begin{pmatrix} D & -B \\ -C & A \end{pmatrix}$$

Now let's define r and s $$AD-BC=(r1r4-r2r3)I+s1(r1+r2)W=rI+sW$$

As a result $$(AD-BC)^{-1}=\frac{1}{r^2+s^2}(rI-sW)$$

$$\begin{pmatrix} a \\ b \\ c \\ d \end{pmatrix}=\frac{p0}{r^2+s^2}\begin{pmatrix} rr4+ss1 \\ -rs1+sr4 \\ -rr3+ss1 \\ -rs1-sr3 \end{pmatrix}$$

The width of x1 is $A1=\sqrt{a^2+b^2}$ and the width of x2 is $$A2=\sqrt{c^2+d^2}$$

$$A1=\frac{p0}{r^2+s^2}(r4^2+s1^2)$$

$$A2=\frac{p0}{r^2+s^2}(r3^2+s1^2)$$

Explicitly, we can write $A1^2$ and $A2^2$ $$A1^2 = p0^2 \frac{c^2\omega^2 + (k - m\omega^2)^2}{\left[\begin{matrix}(K - M\omega^2)(k - m\omega^2) - \\ (k - m\omega^2)\end{matrix}\right]^2 + c^2\omega^2 + (K - M\omega^2 - m\omega^2)^2}$$

$$A2^2 = p0^2 \frac{c^2\omega^2 + k^2}{\left[\begin{matrix}(K - M\omega^2)(k - m\omega^2) - \\ (k - m\omega^2)\end{matrix}\right]^2 + c^2\omega^2 + (K - M\omega^2 - m\omega^2)^2}$$

From here we can write the following constants: autofrequencies:

$$\omega 1^2 = \frac{K}{M}\omega 2^2 = \frac{k}{m}$$

mass ratio $$\xi_2 = \frac{c}{2m\omega 2^2}$$

damping ratio:

$$\mu = \frac{m}{M}$$

wherefrom $$c = 2\xi_2 m\omega 2^2$$

$$C = 2\xi_1 m\omega$$

The stiffness relation is $$k = \mu K$$

The best approximation for the damper frequency is given when the damper is tuned at the fundamental of the structure, that is:

$$\omega 2 = \omega 1$$

$$f = \frac{\omega 2}{\omega 1}$$

wherefrom the optimal frequency $$\omega 2 = f_{opt}\omega 1$$

If we consider the periodical excitation:

$$p = p0\,sen(\Omega t)$$

the response is given by $$u1 = x1\,sen(\Omega t + \delta 1)$$

$$u2 = x2\,sen(\Omega t + \delta 1 + \delta 2)$$

where x and δ indicate the width of the displacement and the phase shift, respectively. The critical load is in the resonance condition Ω=ω, in such a case the solution has the following form:

$$x1 = \frac{p0}{K\mu}\sqrt{\frac{1}{1 + \left(\frac{2\xi_1}{\mu} + \frac{1}{2\xi_2}\right)^2}} \tag{1}$$

$$x2 = \frac{1}{2\xi_2}x1 \tag{2}$$

$$\tan\delta 1 = \left[\frac{2\xi_1}{M} + \frac{1}{2\xi_2}\right]$$

$$\tan\delta 2 = -\frac{\pi}{2}$$

The response without damper is given by:

$$x1 = \frac{p0}{K}\left(\frac{1}{2\xi_1}\right)$$

$$\delta 1 = -\frac{\pi}{2}$$

To compare these two cases, (1) is expressed in terms of equivalent damping ratio:

$$x1 = \frac{p0}{K}\left(\frac{1}{2\xi_e}\right)$$

where $$\xi_\theta = \frac{\mu}{2}\sqrt{1 + \left(\frac{2\xi_1}{M} + \frac{1}{2\xi_2}\right)^2} \tag{3}$$

(3) represents the relative contribution of the damper parameters to the total damping. When the mass ratio increases, the damping will increase.

Dimensioning of the Loudspeaker According to the Invention

Let's suppose that ξ=0 with a damping ratio of 10%. By using (3) and inserting $\xi_e$=0.1, we obtain the following relation between μ and $\xi_2$ $$\frac{\mu}{2}\sqrt{1 + \left(\frac{2\xi_1}{M} + \frac{1}{2\xi_2}\right)^2} = 0.1 \tag{4}$$

The relative displacement is given by (2):

$$x2 = \frac{1}{2\xi_2}x1 \tag{5}$$

Combining (4) and (5) and substituting ξ=0 we obtain:

$$\frac{\mu}{2}\sqrt{1 + \left(\frac{x2}{x1}\right)^2} = 0.1 \tag{6}$$

Approximating (6), eliminating the root and the square with $$\frac{\mu}{2}\left(\frac{x2}{x1}\right)^2 \approx 0.1 \tag{7}$$

The generalized form of (7) follows from (3)

$$\mu \approx 2\xi_\theta\left(\frac{1}{\frac{x2}{x1}}\right)$$

For example, selecting $$x2 = \frac{x1}{20}$$

we reach an estimate of μ:

$$\mu = \frac{2(0.1)}{\frac{1}{20}} = 4 \tag{8}$$

whereas from (2), we obtain $$\xi_2 = \frac{1}{2}\left(\frac{x1}{x2}\right) = 10$$

From the stiffness relation k=μK we obtain $$k=\mu K=20K$$

In the specific case, considering 10% damping, from (8) we obtain a mass (m) of the moving assembly of the shaker that is four times higher than the mass (M) of the moving assembly of the loudspeaker. In similar solutions, advantageously, the mass (m) of the moving assembly of the shaker can be 3-5 times higher than the mass (M) of the moving assembly of the loudspeaker.

Numerous equivalent variations and modifications can be made to the present embodiments of the invention, which are within the reach of an expert of the field, falling in any case within the scope of the invention.

The invention claimed is:

1. A loudspeaker with a vibration control system, the loudspeaker comprising:

a magnetic assembly having a magnet disposed between a lower polar plate and an upper polar plate, wherein the lower polar plate has a core so as to generate an air gap between the core of the lower polar plate and the upper polar plate;

a voice coil supported by a cylindrical support;

a basket connected to said magnetic assembly;

a centering device connected to said basket and to the cylindrical support such that that said voice coil is disposed in the air gap, said centering device movable elastically to allow for an axial movement of the cylindrical support with respect to said magnetic assembly;

a membrane connected to said basket and to the cylindrical support;

an external cylinder disposed around said magnetic assembly;

at least one elastic suspension connected to said external cylinder to allow for an axial movement of the external cylinder with respect to said magnetic assembly; and a pair of control coils supported by said external cylinder and respectively disposed in correspondence to the lower polar plate and said upper polar plate.

2. The loudspeaker of claim 1, wherein said external cylinder is of a ferromagnetic material.

3. The loudspeaker of claim 1, wherein said elastic suspension comprises an internal ring connected to said magnetic assembly, an external ring connected to said external cylinder and a plurality of elastically flexible spokes connecting the internal ring to the external ring of the elastic suspension.

4. The loudspeaker of claim 1, further comprising:

a cup, said external cylinder being integrated into said cup, said cup having a bottom portion disposed under said magnetic assembly.

5. The loudspeaker of claim 4, wherein the elastic suspension connects the cup to the lower polar plate of said magnetic assembly, the elastic suspension comprising leaf springs, helical springs, wave springs or elastic elements made of a plastic material.

6. The loudspeaker of claim 4, wherein the bottom portion of said cup is formed of elastic plastic material, the elastic suspension being at least partially integrated in the bottom portion of said cup.

7. A loudspeaker with a vibration control system, the loudspeaker comprising:

a magnetic assembly comprising a magnet disposed between a lower polar plate and an upper polar plate, wherein the lower polar plate has a core so as to generate an air gap between the core of the lower polar plate and the upper polar plate;

a voice coil supported by a cylindrical support;

a basket connected to said magnetic assembly;

a centering device connected to said basket and to the cylindrical support such that said voice coil is disposed in the air gap, said centering device being movable elastically to allow for an axial movement of the cylindrical support with respect to said magnetic assembly;

a membrane connected to said basket and to the cylindrical support;

an external cylinder disposed around said magnetic assembly;

an elastic suspension connected to said external cylinder so as to allow for an axial movement of said external cylinder with respect to said magnetic assembly; and at least two control coils supported by said external cylinder and disposed in correspondence to a peripheral edge of the upper polar plate, wherein said external cylinder that supports the control coil is connected to the upper polar plate by said elastic suspension.

8. The loudspeaker of claim 7, wherein the lower polar plate has an external diameter that is larger than a diameter of the magnet and of a diameter the upper polar plate, the lower polar plate having a peripheral collar that protrudes on top from an edge of the lower polar plate and is disposed outside said external cylinder so as to form an air gap between the upper polar plate and the peripheral collar of the lower polar plate, wherein the external cylinder is formed of a non-ferromagnetic material, and wherein the control coil is disposed in the air gap.

9. The loudspeaker of claim 7, further comprising:

a first mobile assembly comprising the cylindrical support, said voice coil, said centering device and a membrane; and a second mobile assembly comprising said external cylinder and the control coil, wherein a mass of said second mobile assembly is three to five times greater than a mass of said first mobile assembly.

* * * * *